United States Patent [19]

Hall

[11] Patent Number: 5,061,878

[45] Date of Patent: Oct. 29, 1991

[54] MAGNETRON ANODE AND METHOD OF MANUFACTURING ANODE

[75] Inventor: Peter J. Hall, Chelmsford, United Kingdom

[73] Assignee: English Electric Valve Company Limited, Chelmsford, United Kingdom

[21] Appl. No.: 223,039

[22] Filed: Jul. 21, 1988

[30] Foreign Application Priority Data

Jul. 23, 1987 [GB] United Kingdom ..... 8717440
May 6, 1988 [GB] United Kingdom ..... 8810743

[51] Int. Cl.[5] ..... H01J 9/02; H01J 25/50

[52] U.S. Cl. ..... 315/39.75; 315/39.73; 445/35; 29/600

[58] Field of Search ..... 315/5.13, 5.33, 5.38, 315/39.51, 39.63, 39.67, 39.75, 39.77; 313/157, 158, 326; 445/46, 49, 35, 23; 29/600

[56] References Cited

U.S. PATENT DOCUMENTS

| | | | |
|---|---|---|---|
| 2,437,280 | 3/1948 | Spencer | 313/158 X |
| 2,480,126 | 8/1949 | Frankel | 315/39.51 X |
| 2,548,808 | 4/1951 | Nichols | 445/49 X |
| 2,609,522 | 9/1952 | Hull | 315/39.51 X |
| 2,721,295 | 10/1955 | Posthumus | 313/157 X |
| 2,852,720 | 9/1958 | Crapuchettes | 315/39.75 |
| 2,899,603 | 8/1959 | Jonker et al. | 315/39.77 X |
| 3,011,091 | 12/1961 | Christen et al. | 315/39.73 |
| 3,151,265 | 9/1964 | Stephens | 445/49 X |
| 3,832,760 | 9/1974 | Scott, Jr. | 445/35 |
| 4,041,350 | 8/1977 | Shitara et al. | 315/39.75 |
| 4,146,949 | 4/1979 | Derby, Jr. | 445/35 |

FOREIGN PATENT DOCUMENTS

| | | | |
|---|---|---|---|
| 617937 | 2/1949 | United Kingdom . | |
| 634640 | 3/1950 | United Kingdom . | |
| 724268 | 2/1955 | United Kingdom . | |
| 789586 | 1/1958 | United Kingdom . | |
| 806551 | 12/1958 | United Kingdom . | |
| 834898 | 5/1960 | United Kingdom | 445/49 |
| 895451 | 5/1962 | United Kingdom . | |
| 911924 | 12/1962 | United Kingdom . | |
| 998049 | 7/1965 | United Kingdom . | |

*Primary Examiner*—Eugene R. LaRoche
*Assistant Examiner*—Benny T. Lee
*Attorney, Agent, or Firm*—Spencer & Frank

[57] ABSTRACT

A magnetron anode is manufactured by producing a blank in a sheet of conductive material which is then bent to form an anode vane structure. The structure is then inserted in a cylindrical block and brazed in position to form the magnetron anode. The anode vane structure may be formed from two folded blanks, which are arranged to interengage one another.

24 Claims, 3 Drawing Sheets

MAGNETRON ANODE AND METHOD OF MANUFACTURING ANODE

FIELD OF THE INVENTION

This invention relates to magnetrons and to a method of manufacturing magnetrons, and especially magnetron anodes.

BACKGROUND OF THE INVENTION

A magnetron includes a cathode and an anode, the anode usually being of copper. In a presently known method of making the anode, a cylindrical copper block is machined to produce a central anode bore. The cylindrical block is shown at 1 in FIGS. 1 and 2 respectively which are transverse and longitudinal sections respectively of a magnetron anode. Conventionally, equidistant slots 2 are broached in the surface of the bore in a direction parallel to its longitudinal axis and vanes 3 are then fitted into the slots 2 using a purpose-designed jig. End space fillers 4 and 5 (See FIG. 2) are located on each side of the vanes 3 and the assembly is then brazed together in a furnace.

This known method of producing magnetron anodes is relatively time-consuming, and satisfactory accuracy in locating the vanes and slots may be difficult to achieve, especially where the magnetron is small.

SUMMARY OF THE INVENTION

The present invention seeks to provide an improved method of manufacturing magnetrons.

According to a first aspect of the invention there is provided a method of manufacturing a magnetron comprising the steps of: producing a blank from a sheet of conductive material; and bending the blank to form a vane structure which comprises at least part of the magnetron anode. It is preferred that the vane structure is then inserted in a cylinder. By employing a method in accordance with the invention, the normal requirement to broach slots in an anode bore is eliminated. This therefore reduces the time required to assemble the anode, since it is not necessary to individually fit separate vanes. Also, vane spacings may be formed with great accuracy since these are determined by the dimensions of the blank. The inventive method may therefore be particularly advantageously applied in the manufacture of small magnetrons. A consistent vane geometry may be obtained by using accurate tools for producing the blank and for bending it. This is in contrast to the previously known method in which vanes are produced in separate tools and slot-to-slot spacings can vary. Also, the vane structure formed from the folded blank is relatively stiff and during any subsequent brazing operations the vanes do not move. The inventive method lends itself to high volume protection, and enables a large number of magnetrons to be produced which have very similar operating characteristics.

A blank may be formed into a vane structure by bending it twice, one direction of bending being orthogonal to the other. Once the vane structure is inserted and supported within the cylinder, they may be brazed together.

Advantageously the blank includes a portion which acts as an end space filler in the finished anode.

Preferably, two blanks are produced and bent to form respective vane structures, the vanes of one structure being interleaved with those of the other, thus enabling a larger number of vanes to be formed than might be possible if only a single blank were to be employed. Preferably, they are interleaved such that the vanes of one are arranged alternately with those of the other. It may be advantageous to have it arranged that the vanes of the structure formed from one blank are of a different configuration than those vanes formed from the other blank, for example to enable strapping of the magnetron to be implemented.

In a particularly advantageous feature of the invention, where two vane structures are included, they are arranged to interengage one another. This enables the structures to be self-jigging, thus greatly facilitating assembly. In the case where each blank includes an annular portion and arms radially extensive therefrom, the annular portion of one blank includes a slot with which the free end of an arm of the other blank is engaged. Preferably, each blank comprises a plurality of slots corresponding to the number of arms of the other blank.

According to a second aspect of the invention, there is provided a magnetron comprising an anode having a plurality of anode vanes formed from a folded blank of conductive sheet, such a construction having the advantage of good accuracy. It is preferred that an end space filler is formed by part of the blank. In one embodiment of the invention, the anode vanes are formed from two folded blanks, vanes formed from one blank being interleaved with those from the other. It is particularly advantageous if the folded blanks are arranged to interengage one another, and preferably, one folded blank includes a slot with which an extensive portion from a vane of the other folded blank is engaged. This not only results in a physically robust assembly but also provides good operating characteristics which are particularly stable.

BRIEF DESCRIPTION OF THE DRAWINGS

Some ways in which the invention may be performed are now described with reference to the accompanying drawings, in which.

DESCRIPTION OF PREFERRED EMBODIMENTS

Figure 1:
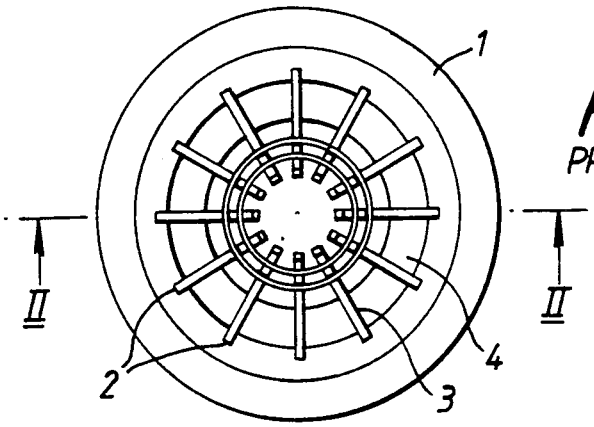
FIG. 1. PRIOR ART
FIGS. 1 and 2 are transverse and longitudinal sections respectively of a conventional magnetron anode.
Figure 2:
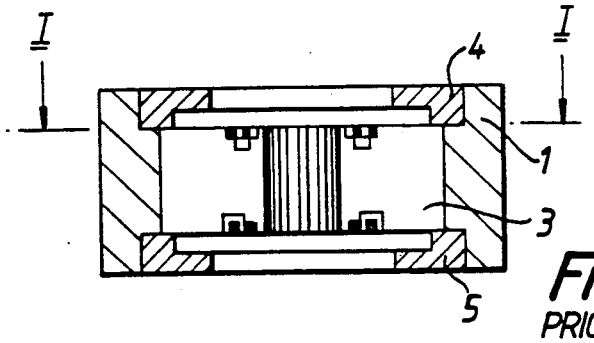
FIG. 2. PRIOR ART
Figure 3:
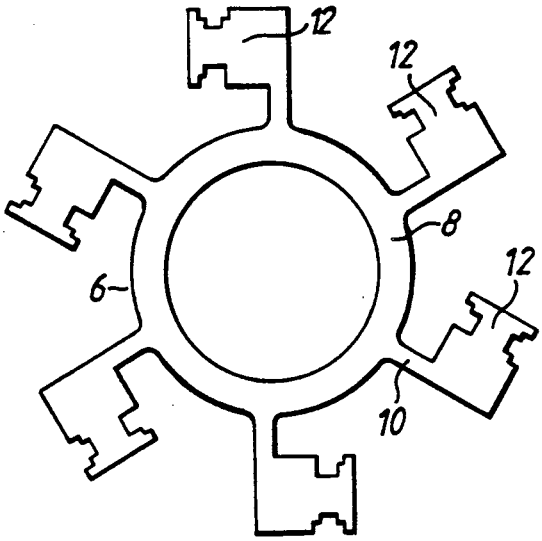
FIGS. 3 and 4 illustrate respective blanks used in a method in accordance with the invention.
Figure 4:
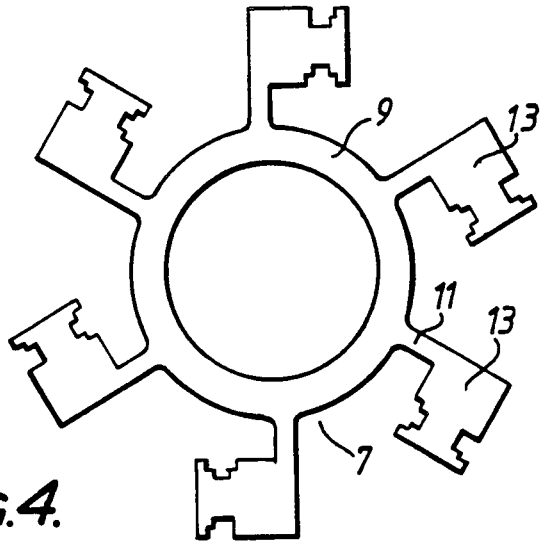

With reference to FIGS. 3 and 4, first and second blanks 6 and 7 are produced from a sheet of copper by press-tooling techniques. The blanks 6 and 7 include annular portions 8 and 9 from which arms 10 and 11 extend in what might be termed a "windmill" configuration, having larger portions 12 and 13 at their free ends. The portions 12 and 13 constitute the vanes in the finished magnetron, those of the first blank 6 being of a different configuration to those of the second blank 7 to enable strapping to be implemented.

Figure 5:
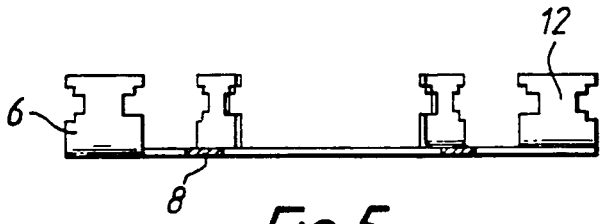
FIGS. 5 and 6 illustrate steps in the method.
Figure 6:
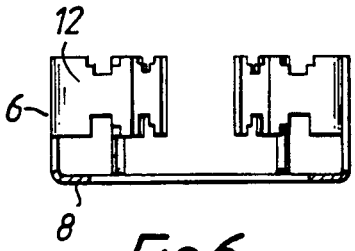

The portions 12 and 13 are bent through 90° in a direction out of the plane of the paper from the position shown in FIGS. 3 and 4, to produce a structure as illustrated in FIG. 5, which is a side view showing the first blank 6. Both blanks 6 and 7 are bent in this way. The arms 10 and 11 are then bent through 90° such that the portions 12 and 13 face inwards as illustrated in FIG. 6, thus forming two vane structures from the blanks 6 and 7.

Figure 8:
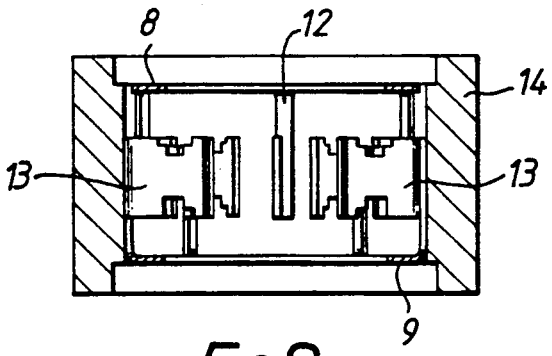
FIGS. 7 and 8 illustrate in transverse and longitudinal sections respectively, a finished magnetron anode.
Figure 7:
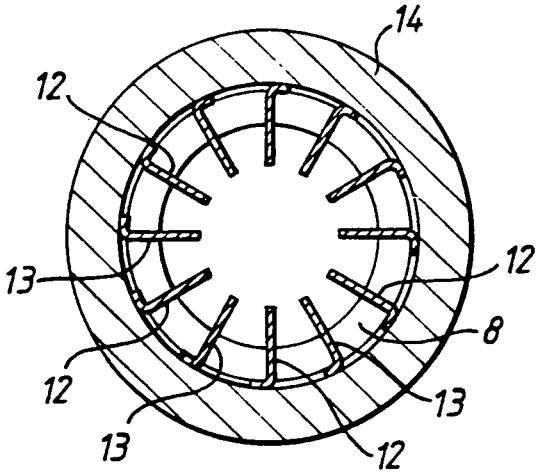

A cylindrical copper block 14 having a central bore is then taken and the first vane structure 6 inserted within the bore from one end and the second vane structure 7 from the other end. The vane structures 6 and 7 are interleaved such that the extensive portions 12 and 13 forming the vanes are arranged alternately around the circumference of the cylindrical bore, as shown in FIG. 7. The annular parts 8 and 9 form end space fillers as illustrated in FIG. 8 . The assembly is then brazed to produce the finished magnetron anode.

The anode is then assembled with the magnetron cathode and pole pieces to complete manufacture of the magnetron.

Figure 9:
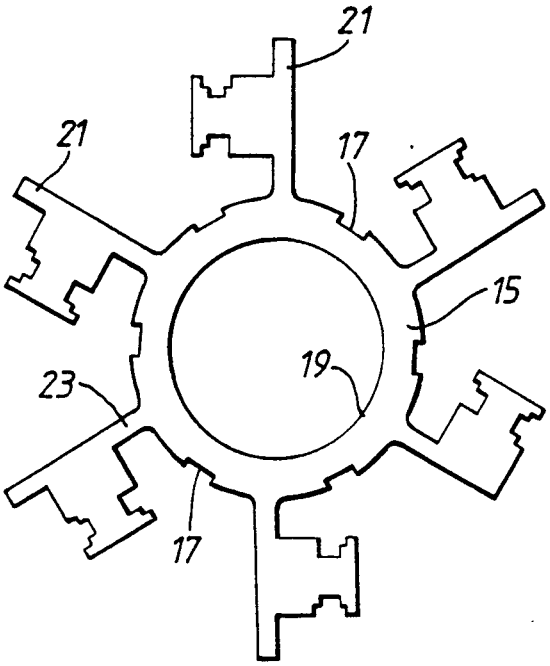
FIGS. 9 and 10 illustrate blanks used in another method in accordance with the invention.
Figure 10:
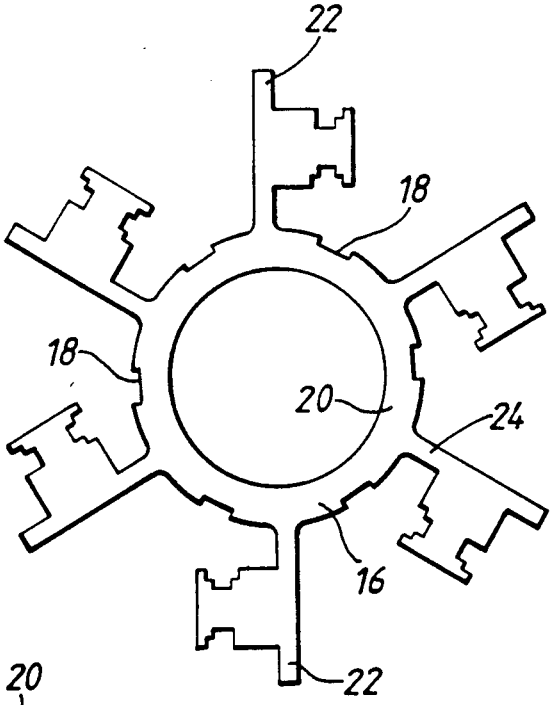

With reference to FIGS. 9 and 10, in another method in accordance with the invention, a magnetron anode includes vane structures formed from the illustrated blanks, 15 and 16. These are similar to those illustrated in FIGS. 3 and 4 but include slots 17 and 18 in the annular portions 19 and 20 and parts 21 and 22 which are extensive from the free ends of the arms 23 and 24. The blanks 15 and 16 are folded in the same manner as described previously.

Figure 11:
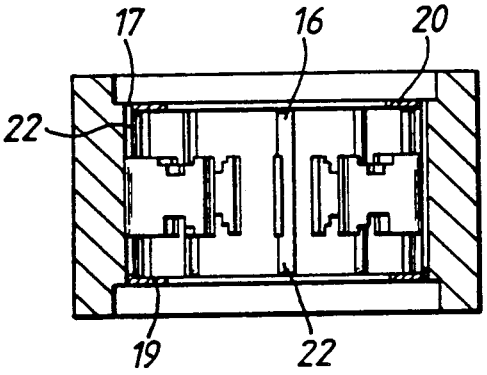
FIG. 11 illustrates a longitudinal section of a magnetron anode made in accordance with the method illustrated by FIG. 9.

The two vane structures thus formed are then interleaved so that the vanes from one blank 15 are alternately arranged with those from the other blank 16. The extensive parts 21 in the blank 15 are fitted into the slots 18 of the other blank 16, and likewise the extensive parts 22 of the blank 16 engaged with the slots 17 of the blank 15. This self-jigging enables alignment of the vanes to be quickly and accurately achieved. The finished magnetron anode, illustrated in FIG. 11, has particularly good operating characteristics.

What is claimed is:

1. A magnetron anode comprising:

a hollow cylinder having first and second ends; and two anode vane structures, each anode vane structure being formed from a folded blank of conductive sheet material and disposed in said cylinder, said anode vane structures each including an annular portion and a plurality of anode vane members integrally formed with and extending from said annular portion, with each said anode vane member having an integrally attached arm extending substantially perpendicularly to said annular portion, and an enlarged width portion which is attached to said arm adjacent a free end of the arm and which enlarged width portion extends substantially perpendicularly to said arm and radially inwardly of said cylinder to form a respective anode vane, said two anode vane structures being disposed in said cylinder so that the respective said annular portions are located at respective ones of the first and second ends of said cylinder and with said vanes formed from one blank being interleaved with those from the other blank, and said folded blanks having means for physically interengaging one another.

2. A method of manufacturing an anode for a magnetron comprising the steps of:

supplying conductive sheet material;

producing at least one blank, having an annular portion with outwardly extending arms having free ends and enlarged width portions at the free ends of the arms, from the conductive sheet material;

bending the arms of the at least one blank to form an anode vane structure with said enlarged width portions being formed to be radially inwardly directed vanes and which comprises at least part of the magnetron anode; and inserting, supporting, and electrically connecting said anode vane structure within a cylinder having first and second ends to form said magnetron anode.

3. A method of manufacturing an anode as recited in claim 2 further comprising the step of brazing the anode vane structure to the cylinder.

4. A method of manufacturing an anode as recited in claim 2, wherein said step of producing at least one blank includes producing two respective of said blanks from said conductive sheet material and said bending step includes bending the arms of each of said blanks to form a respective said anode vane structure; and further comprising the step of interleaving the enlarged portions of one anode vane structure with the enlarged portions of the other anode vane structure; and said inserting step includes inserting one vane structure from the first end of the cylinder and inserting the other one of the two vane structures from the second end of the cylinder.

5. A method of manufacturing an anode for a magnetron as recited in claim 2 wherein said inserting step includes positioning said annular portion so that it acts as an end space filler in said cylinder of a finished anode.

6. A method of manufacturing an anode vane structure for an anode of a magnetron comprising the steps of:

supplying conductive sheet material;

producing at least one blank, having an annular portion with outwardly extending arms having free ends and enlarged width portions at the free ends of the arms, from the conductive sheet material; and bending the arms of the at least one blank to form an anode vane structure with said enlarged width portions being formed to be radially inwardly directed for serving as vanes of said anode vane structure.

7. A method of manufacturing an anode vane structure as recited in claim 6 wherein said step of producing at least one blank includes forming said annular portion as an end space filler for an end of a cylinder into which said vane structure is to be inserted to form a finished anode.

8. A method of manufacturing an anode vane structure for an anode as recited in claim 6 wherein said bending step comprises bending each arm through 90° at a corresponding junction with said annular portion and bending each enlarged portion through 90° with respect to each arm.

9. A method of manufacturing an anode vane structure for an anode as recited in claim 6 wherein said bending step comprises bending the arms of the at least one blank in a first direction, and subsequently bending said enlarged width portions of the at least one blank in a second direction, the second direction of bending being orthogonal to the first direction of bending.

10. A method of manufacturing an anode vane structure as recited in claim 6 wherein said step of producing at least one blank includes producing two respective of said blanks from said conductive sheet material and said bending step includes bending the arms and enlarged portions of each of said blanks to form a respective said anode vane structure; and further comprising the step of interleaving the enlarged portions of one anode vane structure with the enlarged portions of the other anode vane structure.

11. A method of manufacturing an anode vane structure as recited in claim 10 wherein said step of producing at least one blank includes forming the enlarged portions of the anode vane structure formed from one blank to have a first peripheral configuration and the enlarged portions formed from the other blank to have a second peripheral configuration, with said first and second peripheral configurations differing from each other.

12. A method of manufacturing an anode vane structure as recited in claim 10 wherein said interleaving step includes arranging the annular portion of one of the two anode vane structures on one side of the interleaved enlarged portions and arranging the annular portion of the other one of the two anode vane structures on the side of the interleaved enlarged portions opposite said one side.

13. A method of manufacturing an anode vane structure as recited in claim 12 wherein said step of producing at least one blank includes forming the enlarged portions of said anode vane structure formed from one blank to have a first configuration and the enlarged portions formed from the other blank to have a second different configuration.

14. A method of manufacturing an anode vane structure as recited in claim 10 wherein said interleaving step includes interleaving the two anode vane structures such that the enlarged portions of one anode vane structure are arranged alternately with the enlarged portions of the other anode vane structure.

15. A method of manufacturing an anode vane structure as recited in claim 10 wherein said step of producing at least one blank further includes providing the two anode vane structures with respective means for physically interengaging one another when interleaved.

16. A method of manufacturing an anode vane structure as recited in claim 10 wherein said step of producing at least one blank includes providing the annular portion of at least one blank with at least one slot, and engaging said at least one slot with the free end of an arm of the other blank when the anode vane structures are interleaved.

17. A method of manufacturing an anode vane structure as recited in claim 16 wherein said step of producing at least one blank includes providing each blank of the two blanks with a plurality of slots corresponding to the number of arms of the other one of the two blanks.

18. A method of manufacturing an anode vane structure as recited in claim 17 wherein said step of producing at least one blank includes providing the enlarged portions of said anode vane structure formed from one blank with a first peripheral configuration and providing the enlarged portions formed from the other blank with a second peripheral configuration, with said first peripheral configuration being different from said second peripheral configuration.

19. A magnetron anode comprising:

a hollow cylinder having first and second ends; and at least one anode vane structure formed from a folded blank of conductive sheet material and disposed in said cylinder, said at least one anode vane structure including an annular portion and a plurality of anode vane members integrally formed with and extending from said annular portion, with each said anode vane member having an integrally attached arm defining a plane and extending substantially perpendicularly to said annular portion, and an enlarged width portion which is integrally attached to said arm adjacent a free end of the arm and which enlarged width portion defines a plane which extends substantially perpendicularly to the plane of said arm and radially inwardly of said cylinder to form a respective anode vane.

20. A magnetron anode as recited in claim 19 wherein said annular portion forms an end space filler for said cylinder.

21. A magnetron anode as recited in claim 19 including two of said at least one anode vane structures formed from to folded blanks of conductive sheet material, with said two vane structures being disposed in said cylinder so that the respective said annular portions are located at respective ones of the first and second ends of said cylinder and with said vanes formed from one blank being interleaved with those from the other blank.

22. A magnetron anode as recited in claim 21 wherein the vanes of one blank are alternately arranged with those of the other blank.

23. A magnetron anode as recited in claim 21 wherein said folded blanks are arranged to include means for physically interengaging one another.

24. A magnetron anode as recited in claim 23 wherein said means for interengaging includes a slot disposed on said annular portion of one of said blanks and engaging a portion of an arm of the other said folded blank which extends beyond the respective said enlarged portion forming a vane.

* * * * *